US005688579A

United States Patent [19]

Konsti et al.

[11] Patent Number: 5,688,579

[45] Date of Patent: Nov. 18, 1997

[54] MOUNTING COMPOSITE

[75] Inventors: Patricia R. Konsti, Oakdale; Robert J. Wolf, Woodbury, both of Minn.; Mary K. Miller-Bruns, Cedar Park, Tex.; Christine M. Sawka, Woodbury, Minn.

[73] Assignee: Minnesota Mining and Manufacturing Company, St. Paul, Minn.

[21] Appl. No.: 524,882

[22] Filed: Sep. 7, 1995

Related U.S. Application Data

[63] Continuation-in-part of Ser. No. 261,864, Jun. 17, 1994, abandoned.

[51] Int. Cl.[6] ..... B32B 9/00

[52] U.S. Cl. ..... 428/192; 428/100; 428/193; 428/196; 428/203; 428/224; 428/236; 428/904.4

[58] Field of Search ..... 428/100, 192, 428/193, 196, 200, 203, 204, 225, 236, 226, 904.4

[56] References Cited

U.S. PATENT DOCUMENTS 4,290,174 9/1981 Kalleberg ..... 24/204
5,058,247 10/1991 Thomas et al. ..... 24/448
5,077,870 1/1992 Melbye et al. ..... 24/452

FOREIGN PATENT DOCUMENTS 1 915 098 10/1970 Germany .
23 52 193 4/1975 Germany .
944994 12/1963 United Kingdom .

*Primary Examiner*—Patrick Ryan
*Assistant Examiner*—Abraham Bahta
*Attorney, Agent, or Firm*—Gary L. Griswold; Walter N. Kirn; William L. Huebsch

[57] ABSTRACT

A mounting composite for removably mounting sheet materials on a vertical wall formed of woven or knitted fabric. The mounting composite comprises a support layer with means along its front surface for retaining and displaying sheet materials, and a fastener attached along a rear major surface of the support layer. The fastener can include a multiplicity of aligned curved hook-like projections, or upstanding stems with mushroom heads. The mounting composite can be firmly removably attached on a vertical wall covered with woven or knitted fabric by engagement of the hook-like projections mushroom heads with the fibers of the fabric.

32 Claims, 6 Drawing Sheets

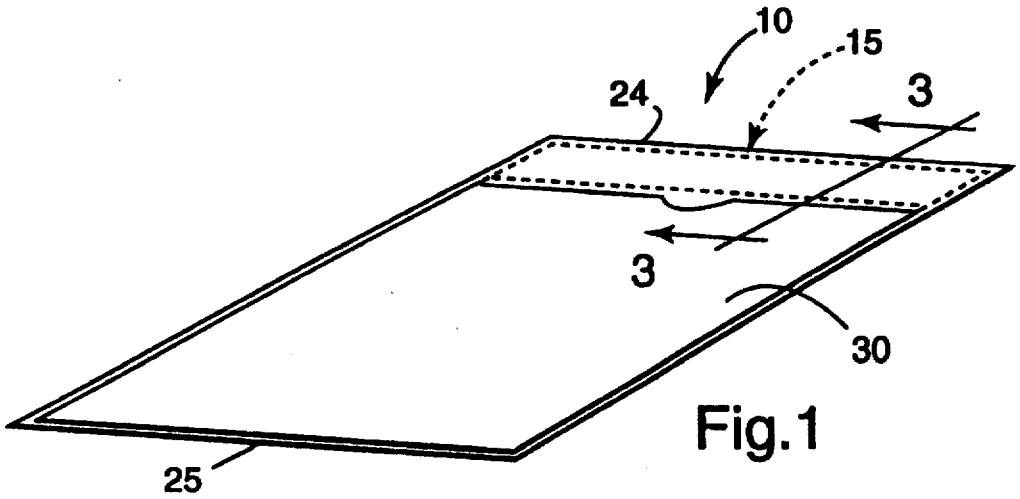
Fig.1
Fig.2
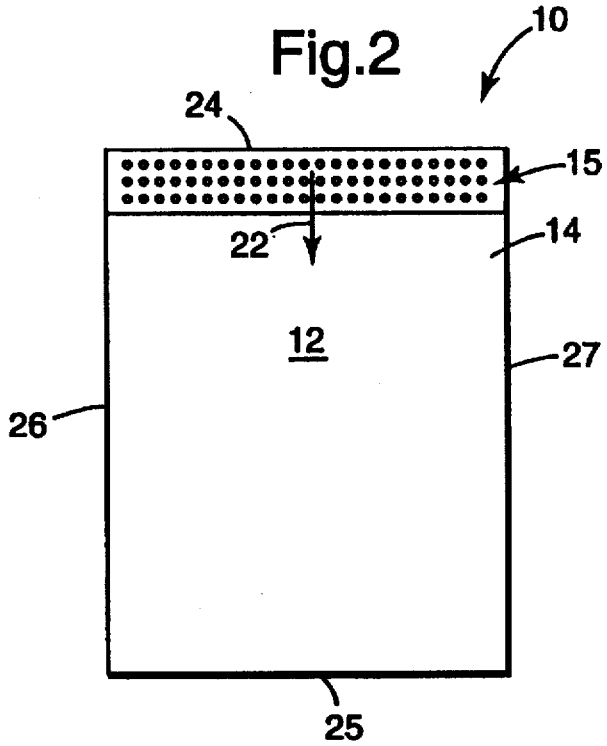
Fig.3A
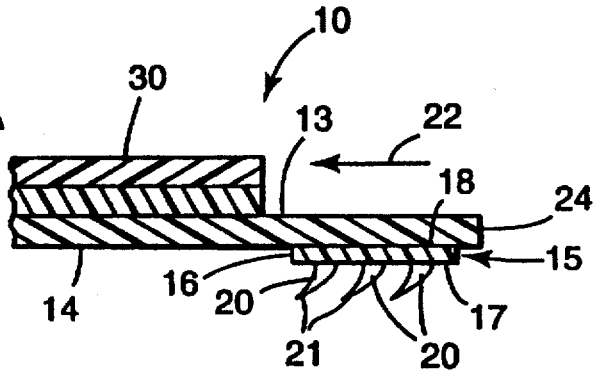

MOUNTING COMPOSITE

CROSS REFERENCE TO RELATED APPLICATION

This application is a continuation-in-part of U.S. patent application Ser. No. 08/261,864 filed Jun. 17, 1994 abandoned.

TECHNICAL FIELD

The present invention relates to means for removably mounting sheet materials on a vertical wall having an outer layer of woven or knitted fabric such as is often used as a partition to form office cubicles.

BACKGROUND ART

The known means for removably mounting sheet materials on a vertical wall having an outer layer of woven or knitted fabric such as is often used as a partition to form office cubicles include thumb tacks, map tacks, push pins, common pins, T-shaped pins, clips, hangers, hooks, bent or twisted paper clips or the hook portion of conventional hook and loop fasteners. These means are generally undesirable because most need to penetrate and thereby damage sheet materials they are attaching to the wall and can also damage the wall. They often fall off of the wall when bumped, whereupon they may pose a hazard to personnel. Also, sheet materials mounted by many of these means curl rather than laying flat, making it difficult to view and retrieve information on the sheet materials and presenting a generally untidy appearance.

DISCLOSURE OF INVENTION

The present invention can removably mount sheet materials on a vertical wall having an outer surface formed of woven or knitted fabric such as is often used as a partition to form office cubicles without causing damage to the wall or to the sheet materials being mounted. Also, the present invention can include means for protecting those sheet materials from curl and soiling due to routine handling, thereby contributing to an aesthetic and organized appearance for the sheet materials mounted on the wall.

According to the present invention there is provided a mounting composite for removably mounting sheet materials on a vertical wall having an outer surface formed by woven or knitted fabric. The mounting composite comprises a support layer; means along and attached to a front surface of the support layer for retaining and displaying sheet materials along that front surface; and fastener means along a rear major surface of the support layer including a multiplicity of small hook-like projections adapted to be removably attached on the woven or knitted fabric.

The means along and attached to the front surface of the support layer for retaining and displaying sheet materials along that front surface can be provided by an envelope-like receptacle for receiving the sheet materials in which the sheet materials can be viewed through a transparent wall of the receptacle. Alternatively, that means can comprise a layer of repositionable or removable pressure sensitive adhesive along the front surface to which the sheet materials are releasably adhered, and, optionally, can further include a transparent layer that can overlay and protect the sheet material adhered to the layer of pressure sensitive adhesive.

The small hook-like projections adapted to be removably attached on the woven or knitted fabric can be curved, can decrease in cross sectional area away from the support layer to a pointed end portion opposite the support layer, and can be curved away from the support layer in the same direction (called the "hook" direction herein) generally parallel to the front surface of the support layer with the pointed end portions being generally pointed in that hook direction. The mounting composite can then be removably attached to the fabric of the vertical wall with the pointed end portions of the hook-like projections directed generally vertically downwardly. Because of the shape and uniform alignment of such hook portions, they can engage the woven or knitted fabric to firmly support the mounting composite, and can subsequently be removed from that fabric without significantly damaging the fibers forming that fabric.

Alternatively, the hook-like projections adapted to be removably attached on the woven or knitted fabric can be very small and have upstanding stems and a mushroom head at the end of each stem opposite the base layer, which mushroom heads can be generally semi-spherical or have circular disc shapes with generally planar end surfaces opposite the base layer.

BRIEF DESCRIPTION OF DRAWING

The present invention will be further described with reference to the accompanying drawing wherein like reference numerals refer to like parts in the several views, and wherein:

FIG. 1 is a perspective view of a first embodiment of a mounting composite according to the present invention;

FIG. 2 is a rear view of the embodiment of the mounting composite illustrated in FIG. 1

FIG. 3A is an enlarged fragmentary sectional view taken approximately along line 3—3 of FIG. 1;

DETAILED DESCRIPTION

Figure 3B:
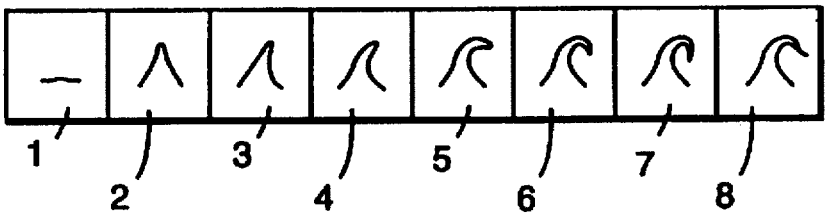
FIG. 3B illustrates possible forms for hook-like projections on fastener strips in the mounting composite of FIG. 1.

Referring now to FIGS. 1, 2 and 3A of the drawing, there is shown a mounting composite according to the present invention generally designated by the reference numeral 10 that is adapted for removably mounting sheet materials on a vertical wall covered with woven or knitted fabric (i.e., woven or knitted fabric having thread densities in the range of about 8 to 32 threads per inch which are commonly made of all polyester fibers or of blends of polyester fibers with fibers of other materials).

Generally the mounting composite 10 comprises a backing layer 12 having opposite from and rear major surfaces 13 and 14; means along the front surface 13 of the backing layer 12 and attached to the backing layer 12 for retaining and displaying sheet materials along that front surface 13; and a first fastener strip 15 including a base layer 16 having opposite front and rear major surfaces 17 and 18. The rear major surface 18 of the base layer 16 is attached surface to surface along the rear major surface 14 of the backing layer 12 so that together the base layer 16 and the backing layer 12 provide a support layer for the mounting composite 10. In addition to the backing layer 12, the fastener strip 15 further includes a multiplicity of curved hook-like projections 20. As can best be seen in FIG. 3A, each hook-like projection 20 is integral with the base layer 16, decreases in cross sectional area away from the base layer 16, has a pointed end portion 21 opposite the base layer 16, and is curved away from the base layer 16 in the same hook direction (the hook direction being indicated by the arrow 22) generally parallel to the front surface 17 of the base layer 16 with the pointed end portions 21 all being generally pointed in the hook direction 22.

The fastener strip can be made generally in accordance with the process of manufacture described in U.S. Pat. No. 5,058,247, the content whereof is incorporated herein by reference. The fastener strip has in the range of about 300 to 1300 hook-like projections per square inch, which hook-like projections typically project above the base of the fastener by a distance generally in the range of 0.012 to 0.025 inch. FIG. 3B illustrates different hook forms that can be made by the process of manufacture described in U.S. Pat. No. 5,058,247, which forms are numbered sequentially from 1 through 8. The hook forms as illustrated in FIG. 3B that are useful in the present invention are those of number 3 or higher with the preferred form being a form in the range between form 3 and form 5.

The mounting composite 10 is adapted to be removably attached on a vertical wall covered with woven or knitted fabric with the pointed end portions 21 of the hook-like projections 20 directed generally vertically downwardly. Because of the shape and uniform alignment of the end portions 21 of the hook-like projections 20, the hook-like projections 20 can be engaged with the woven or knitted fabric to firmly support the mounting composite 10 by pressing the hook-like projections 20 against the fabric with the hook direction 22 being downwardly toward the floor, and pulling the mounting composite 10 slightly downward to engage the hook-like projections 20 in the fabric; and can subsequently be removed from that fabric without damaging the fibers forming it by lifting the mounting composite 10 upwardly (i.e., opposite to the hook direction) relative to the fabric.

The backing layer 12 of the mounting composite 10 can be made of a transparent polymeric material (e.g., of vinyl, polyester, polyolefins, cellulose acetate, or polycarbonate) and has a rectangular periphery defined by opposite first and second parallel end edges 24 and 25 and longer first and second parallel side edges 26 and 27. The base layer 16 of the fastener strip 15 is elongate and is fastened as by a suitable adhesive or by heat sealing to the rear surface 14 of the backing layer 12 along the first end edge 24 with the hook direction 22 being at right angles to the first end edge 24 and directed toward the second end edge 25.

In the mounting composite 10, the means along the front surface 13 and attached to the backing layer 12 for retaining and displaying sheet materials along the front surface 13 is a transparent polymeric front layer 30 (e.g., of vinyl, polyester, polyolefins, cellulose acetate, or polycarbonate) having a periphery of the same size and shape as a major portion of the backing layer 12 and having its periphery attached to the periphery of the backing layer 12 along the side edges 26 and 27 and along the second end edge 25 by means such as heat sealing to form an envelope-like mounting composite 10. The periphery of the front layer 30 adjacent the first end edge 24 of the backing layer 12 is unattached to the backing layer 12 to afford positioning sheet materials between the front surface 13 and the front layer 30, after which those sheet materials may be viewed through the front layer 30.

Figure 4:
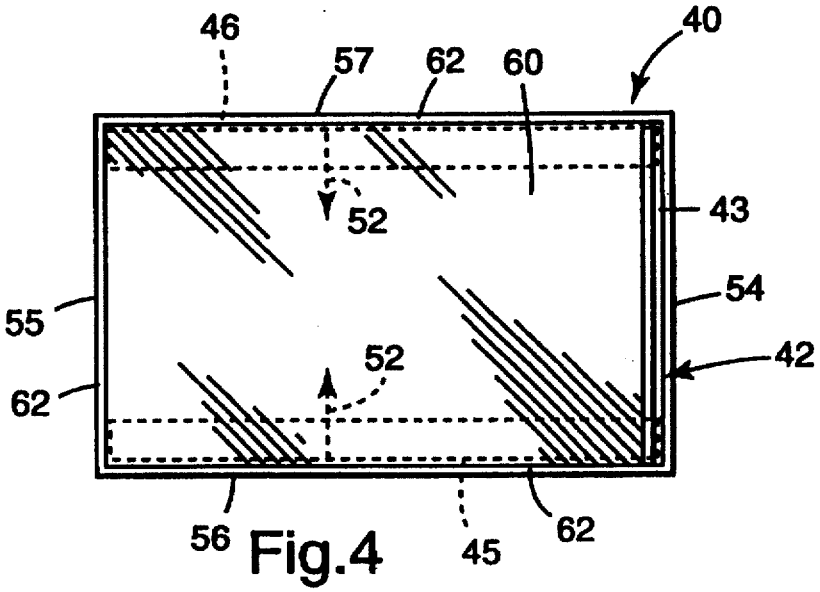
FIG. 4 is a front view of a second embodiment of a mounting composite according to the present invention.
Figure 5:
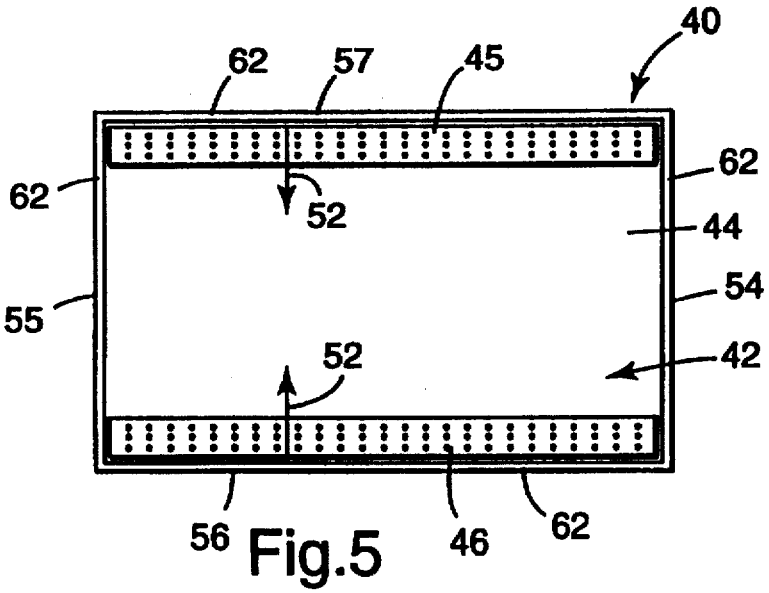
FIG. 5 is a rear view of the embodiment of the mounting composite illustrated in FIG. 4.

Referring now to FIGS. 4 and 5 of the drawing, there is shown a mounting composite according to the present invention generally designated by the reference numeral 40 that is also adapted for removably mounting sheet materials on a vertical wall covered with woven or knitted fabric.

Generally the mounting composite 40 comprises a backing layer 42 having opposite front and rear major surfaces 43 and 44; means along the front surface 43 of the backing layer 42 and attached to the backing layer 42 for retaining and displaying sheet materials along that front surface 43; and first and second fastener strips 45 and 46 that have the same structure as the fastener strip 15 described above including (1) base layers attached to the backing layer 42 so that together they provide a support layer for the mounting composite 40, and (2) curved hook-like projections with pointed end portions all curved away from their base layers in the same hook direction indicated by the arrows 52 generally parallel to the rear surfaces of their base layers and to the rear surface 44.

The mounting composite 40 is adapted to be removably attached on a vertical wall formed of or covered with woven or knitted fabric with the pointed end portions of the hook-like projections on either one of the fastener strips 45 or 46 directed generally vertically downwardly to engage the woven or knitted fabric as described above. However, even if the mounting composite 40 is attached to that woven or knitted fabric with the first and second fastener strips 45 and 46 extending vertically and the hook directions 52 for those strips being opposed and horizontal, the opposed hook-like projections of the two fastener strips 45 and 46 will engage the woven or knitted fabric sufficiently to hold the mounting composite 40 in place on the vertical wall.

The backing layer 42 of the mounting composite 40 can be of an opaque or transparent polymeric material (e.g., of vinyl or polyolefins) or of paperboard and has a rectangular periphery defined by opposite first and second parallel end edges 54 and 55 and first and longer second parallel side edges 56 and 57. The base layers of the fastener strips 45 and 46 are elongate and each fastener strip 45 or 46 is fastened as by a suitable adhesive or by heat sealing to the rear surface 44 of the backing layer 42 along a different one of the opposite side edges 56 and 57 with each of their hook directions 52 being at right angles to the first side edges 56 and 57 and directed toward the opposite fastener strip 45 or 46 and the opposite side edge 56 or 57.

In the mounting composite 40, the means along the front surface 43 and attached to the backing layer 42 for retaining and displaying sheet materials along the front surface 43 is a transparent polymeric front layer 60 (e.g., of vinyl, polyester, polyolefins, cellulose acetate, or polycarbonate) which can optionally have a matte front surface. The front layer 60 has a periphery of the same size and shape as a major portion of the backing layer 42 and has its periphery attached to the periphery of the backing layer 42 along the side edges 56 and 57 and along its second end edge 55 as by a strip of binding material 62 wrapped around those edges and adhered thereto by a suitable adhesive or by heat sealing. The periphery of the front layer 60 adjacent the first end edge 54 of the backing layer 42 is unattached to the backing layer 42 to afford positioning sheet materials between the front surface 43 and the front layer 60, after which those sheet materials may be viewed through the front layer 60.

Figure 6:
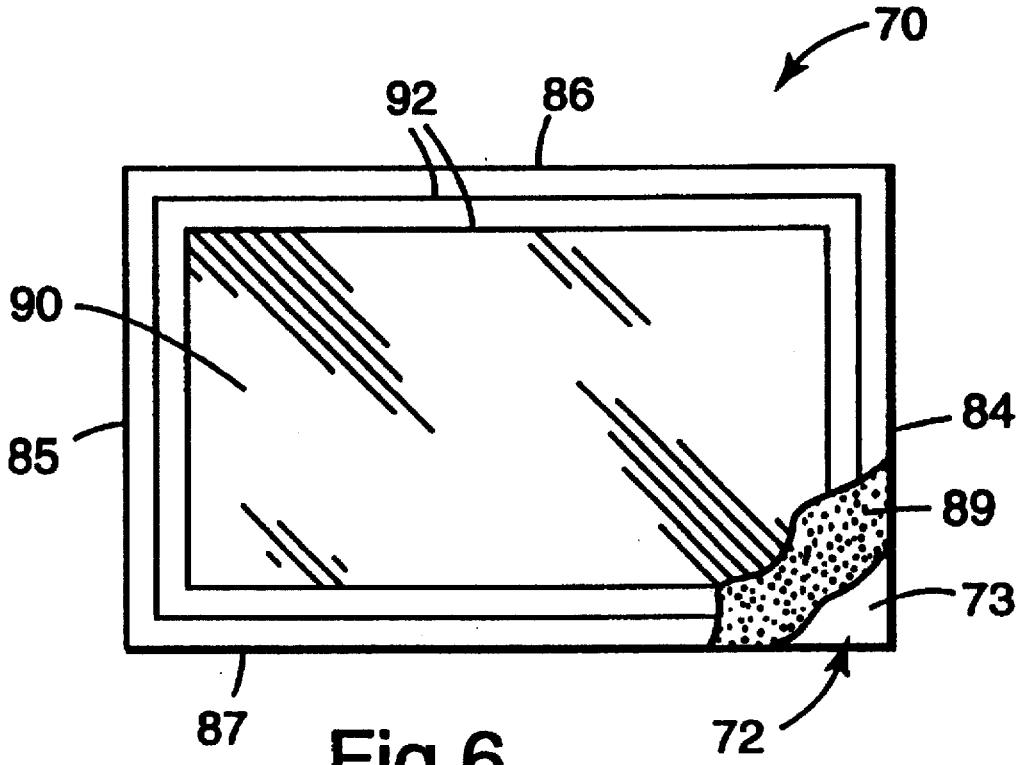
FIG. 6 is a front view of a third embodiment of a mounting composite according to the present invention having parts broken away to show detail.
Figure 7:
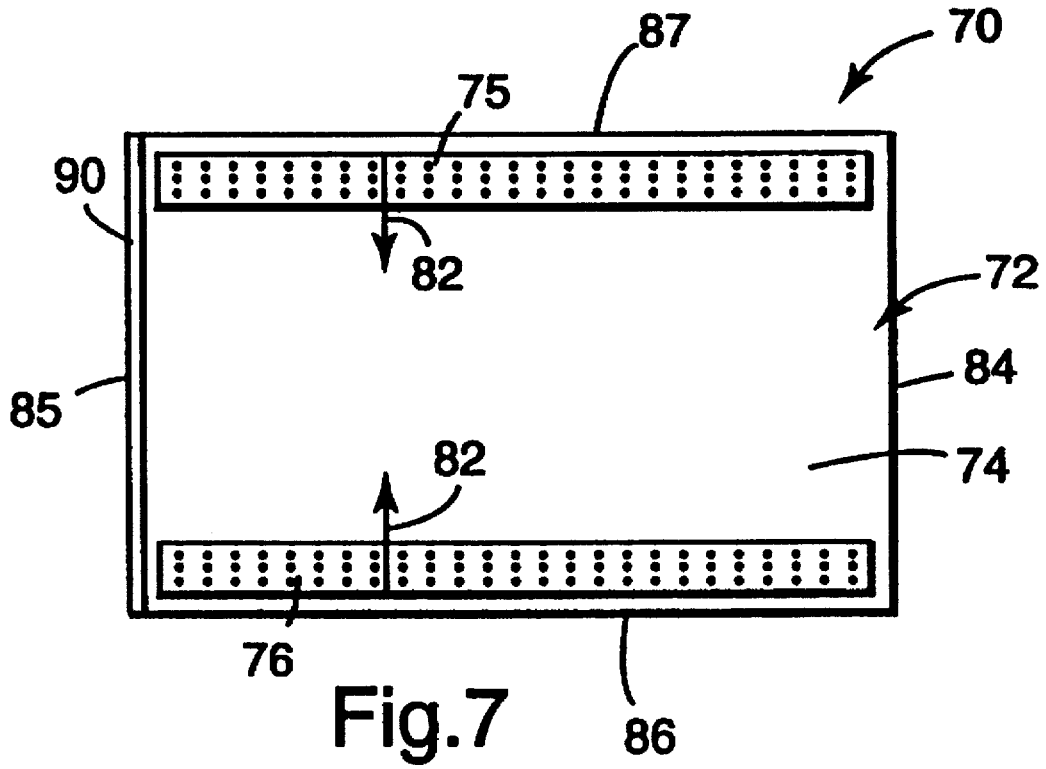
FIG. 7 is a rear view of the embodiment of the mounting composite illustrated in FIG. 6.

Referring now to FIGS. 6 and 7 of the drawing, there is shown a mounting composite according to the present invention generally designated by the reference numeral 70 that is also adapted for removably mounting sheet materials on a vertical wall covered with woven or knitted fabric.

Generally the mounting composite 70 comprises a backing layer 72 having a from major surface 73 and an opposite rear major surface 74; means along the front surface 73 of the backing layer 72 and attached to the backing layer 72 for retaining and displaying sheet materials along that front surface 73; and first and second fastener strips 75 and 76 that have the same structure as the fastener strip 15 described above with their pointed end portions all curved away from their base layers in the same hook direction indicated by the arrow 82 generally parallel to the front surfaces of their base layers and to the rear surface 74.

The mounting composite 70 is also adapted to be removably attached on a vertical wall covered with woven or knitted fabric with the pointed end portions of the hook-like projections on either one of the fastener strips 75 or 76 directed generally vertically downwardly to engage the woven or knitted fabric as described above. However, even if the mounting composite 70 is attached to that woven or knitted fabric with the first and second fastener strips 75 and 76 extending vertically and the hook directions 82 for those strips being horizontal, the hook-like projections of the two fastener strips 75 and 76 will engage the woven or knitted fabric sufficiently to hold the mounting composite 70 in place on the vertical wall.

The backing layer 72 of the mounting composite 40 can be of opaque or of transparent material (e.g., of vinyl, polyolefin, or paperboard) and has a rectangular periphery defined by opposite first and second parallel end edges 84 and 85 and longer first and second parallel side edges 86 and 87. The base layer of the fastener strips 75 and 76 are elongate and each fastener strip 75 or 76 is fastened as by a suitable adhesive to the rear surface 74 of the backing layer 72 along a different one of the opposite side edges 86 and 87 with each of their hook directions 82 being at right angles to the first side edges 86 and 87 and directed toward the opposite fastener strip 75 or 76 and the opposite side edge 86 or 87.

In the mounting composite 70, the means along the front surface 73 and attached to the backing layer 72 for retaining and displaying sheet materials along the front surface 73 comprises a layer 89 of repositionable or removable pressure sensitive adhesive along the front surface 73 and a transparent polymeric front layer 90 (e.g., of vinyl, polyester, or polyolefin) having a periphery of the same size and shape as the backing layer 72 and having its periphery attached to the periphery of the backing layer 72 along the second side edge 85 by having an end part thereof folded around and adhered to the first side edge 85 and to the rear surface 74 of the backing layer 72. The front layer 90 is separable from the layer 89 of pressure sensitive adhesive and is pivotable away from that front surface 73 around the second side edge 85 to afford (1) adhering sheet materials to the layer 89 of pressure sensitive adhesive, and subsequently (2) adhering the transparent front layer 90 to portions of the layer 89 of pressure sensitive adhesive exposed around those sheet materials so that it extends over those sheet materials, after which those sheet materials may be viewed through the transparent front layer 90.

As illustrated, the front layer 90 can optionally have spaced lines 92 or other figures in the shape of a frame printed around its periphery.

Figure 8:
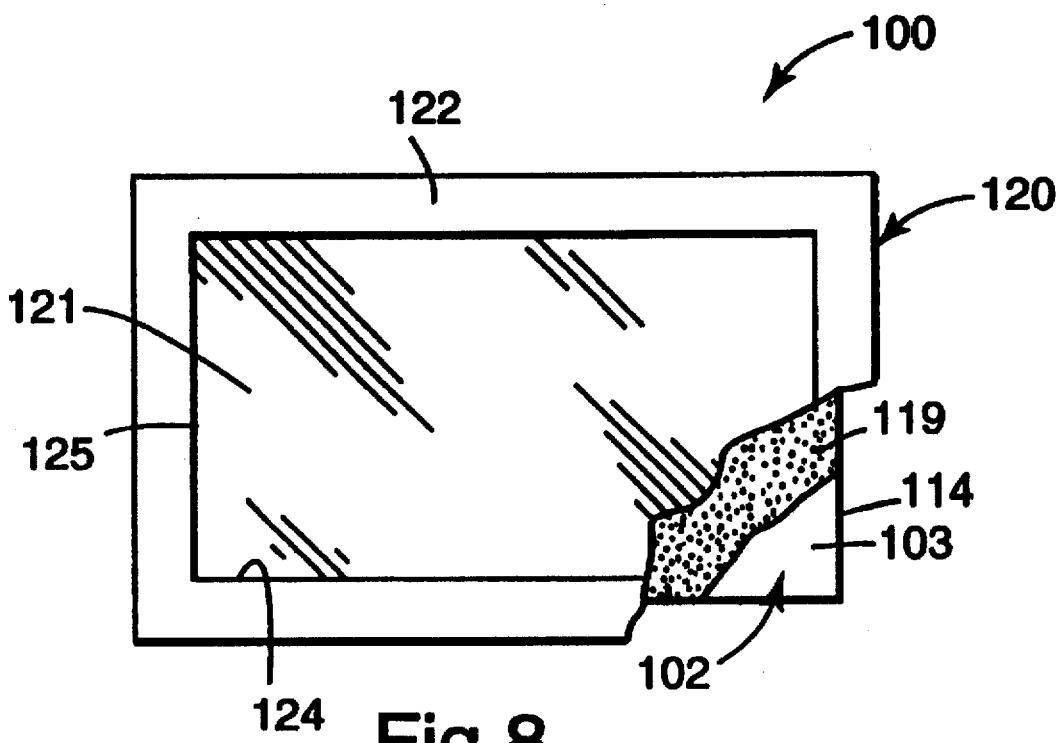
FIG. 8 is a front view of a forth embodiment of a mounting composite according to the present invention having parts broken away to show detail.
Figure 9:
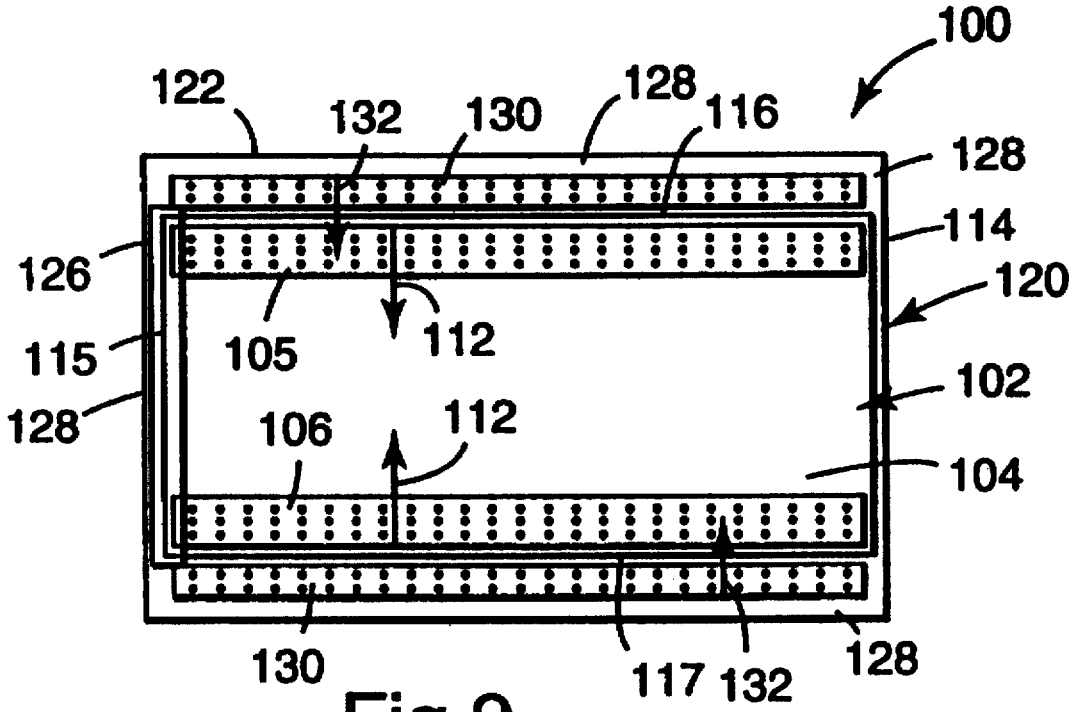
FIG. 9 is a rear view of the embodiment of the mounting composite illustrated in FIG. 8.

Referring now to FIGS. 8 and 9 of the drawing, there is shown a mounting composite according to the present invention generally designated by the reference numeral 100 that is also adapted for removably mounting sheet materials on a vertical wall covered with woven or knitted fabric.

Generally the mounting composite 100 comprises a backing layer 102 having a front major surface 103 and an opposite rear major surface 104; means along the front surface 103 of the backing layer 102 and attached to the backing layer 102 for retaining and displaying sheet materials along that front surface 103; and first and second fastener strips 105 and 106 that have the same structure as the fastener strip 15 described above including curved hook-like projections with pointed end portions all curved away from their base layers in the same hook direction indicated by the arrow 112 generally parallel to the rear surfaces of their base layers and to the rear surface 104.

The mounting composite 100 is also adapted to be removably attached on a vertical wall covered with woven or knitted fabric with the pointed end portions of the hook-like projections on either one of the fastener strips 105 or 106 directed generally vertically downwardly to engage the woven or knitted fabric as described above, however, even if the mounting composite 100 is attached to that woven or knitted fabric with the first and second fastener strips 105 and 106 extending vertically and the hook directions 112 for those strips being opposed and horizontal, the hook-like projections of the two fastener strips 105 and 106 will engage the woven or knitted fabric sufficiently to hold the mounting composite 100 in place on the vertical wall.

The backing layer 102 of the mounting composite 100 can be of opaque or of transparent material (e.g., of vinyl, polyolefin, or paperboard) and has a rectangular periphery defined by opposite first and second parallel end edges 114 and 115 and longer first and second parallel side edges 116 and 117. The base layer of the fastener strips 105 and 106 are elongate and each fastener strip 105 or 106 is fastened as by a suitable adhesive to the rear surface 104 of the backing layer 102 along a different one of the opposite side edges 116 and 117 with each of their hook directions 112 being at fight angles to the first side edges 116 and 117 and directed toward the opposite fastener strip 105 or 106 and the opposite side edge 116 or 117.

In the mounting composite 100, the means along the front surface 103 and attached to the backing layer 102 for retaining and displaying sheet materials along the front surface 103 comprises a layer 119 of repositionable or removable pressure sensitive adhesive along the front surface 103 and a frame assembly 120 including a transparent polymeric front layer 121 having peripheral edges and a rectangular frame 122 attached to the front layer 121 as by a suitable adhesive. The frame 122 is rectangular and has an inner edge 124 extending around a portion 125 of the front layer 121. That portion 125 of the front layer 121 extends along at least a portion of the front surface 103 of the backing layer 102 and the backing layer 102 has one of its edges attached along the rear surface of the frame 122 by a layer 126 of adhesive coated tape or by some other suitable means. The front layer 121 is separable from the layer 119 of pressure sensitive adhesive and the frame assembly 120 is pivotable away from the front surface 103 at that one edge to afford adhering sheet materials to the layer 119 of pressure sensitive adhesive, and subsequently, to adhere the front layer 121 to any exposed portions of the layer 119 of pressure sensitive adhesive around those sheet materials while extending over those sheet materials, after which those sheet materials may be viewed through the front layer 121.

The frame 122 has extending portions 128 projecting past the edges of the backing layer 102 and the mounting composite further includes a pair of auxiliary fastening strips 130 having essentially the same structure as the fastener strip 15 described above. The auxiliary fastener strips 130 are each fastened along the extending portions 128 parallel to and adjacent to one of the first and second fastener strips 105 or 106 with the hook directions 132 for the auxiliary fastener strips 130 being the same as the hook direction 112 for the adjacent first or second fastener strip 105 or 106. Thus, the auxiliary fastener strips 130 help to both attach the mounting composite 100 on a woven or knitted fabric, and help to retain the front layer 121 and frame 122 over sheet materials adhered to the layer 119 of pressure sensitive adhesive, which sheet materials might totally cover that layer 119 of pressure sensitive adhesive.

In any of the above embodiments, the fastener strips may alternatively, have the structure described in U.S. Pat. No. 5,058,247, the structure described in U.S. Pat. No. 5,077,870 issued Jan. 7, 1992, the content whereof is incorporated herein by reference, or the structure described in U.S. patent application Ser. No. 08/048,874 filed Apr. 16, 1993, the content whereof is incorporated herein by reference.

Figure 10:
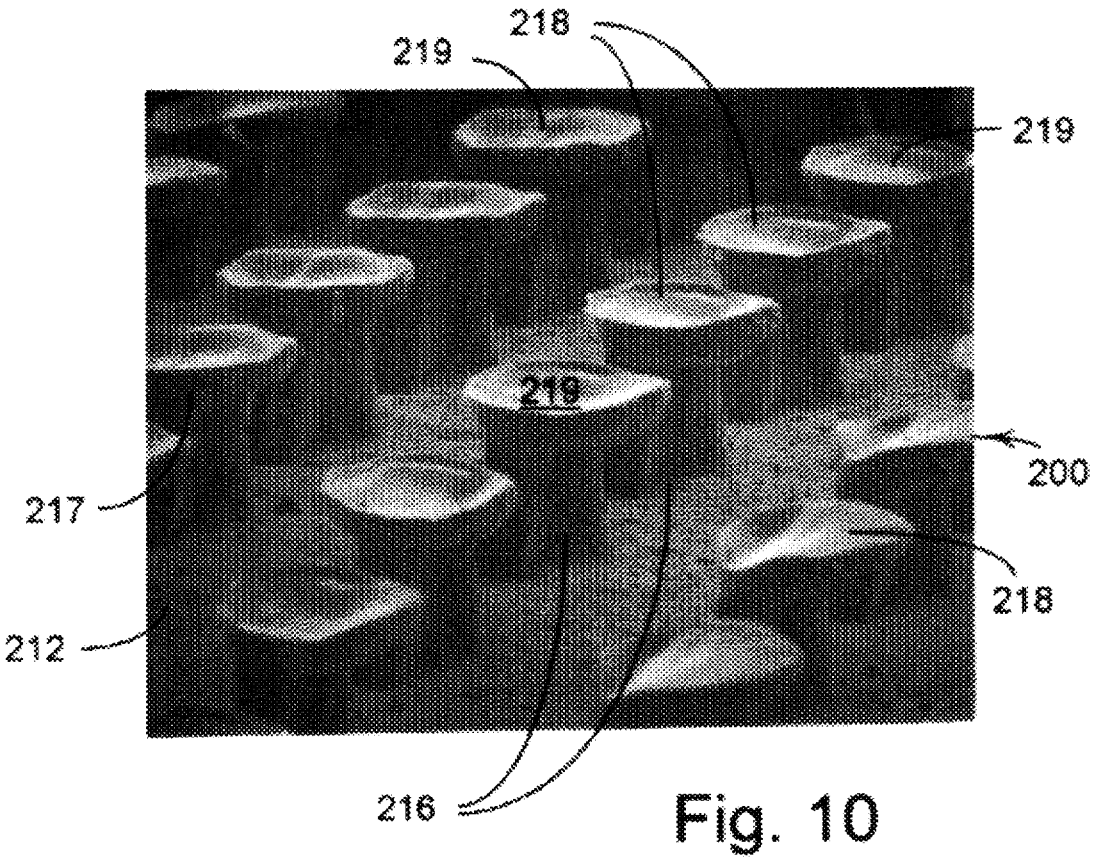
FIG. 10 is an enlarged photograph of an alternate hook strip that can be used in the mounting composite.
Figure 11:
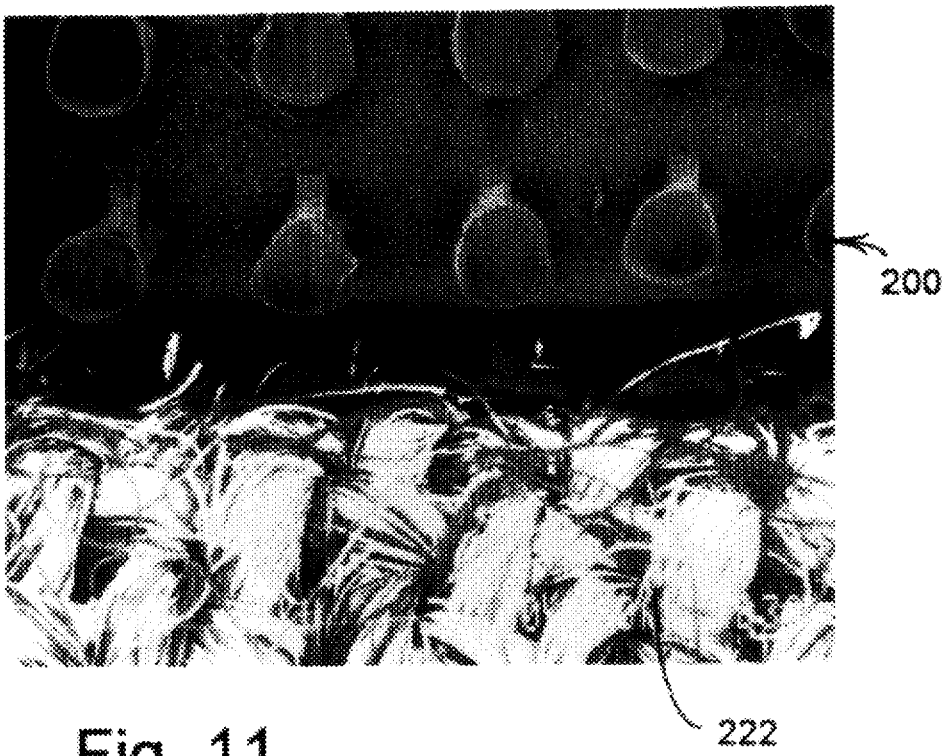
FIG. 11 is an enlarged photograph of the alternate hook strip illustrated in FIG. 10 being engaged with a woven material.

Generally, with reference to FIGS. 10 and 11, U.S. patent application Ser. No. 08/048,874 describes a mushroom-type hook strip 200 comprising a homogeneous backing or base layer 212 of thermoplastic resin and, integral with that backing 212, an array of upstanding stems 216 distributed across a front major surface of the backing 212, each having a mushroom head 218, said stems 216 having a molecular orientation as evidenced by a birefringence value of at least 0.001, and the mushroom heads 218 having circular disc shapes with generally planar end surfaces 219 opposite the backing, which disc shaped heads 218 preferably have diameter to thickness ratios of greater than about 1.5 to 1.

A method of making the mushroom-type hook strip employs a mold which can be cylindrical and has cavities recessed from a continuous surface that are the negatives of an array of upstanding stems. The method involves the steps of a) moving the surface of the mold along a predetermined path, b) continuously injecting a molten, molecularly orientable thermoplastic resin into the cavities in excess of the amount that would fill the cavities, which excess forms a layer of resin overlying the cavities and the surface around the cavities, c) continuously cooling the mold around the cavities to cause the molten resin to become molecularly oriented while it fills the cavities, d) allowing the injected resin to solidify, e) continuously stripping from the mold the solidified resin layer as a backing and integral array of upstanding stems, and f) deforming the tips of the stems by contact with a heated surface to produce a circular disc shaped mushroom head 218 at the tip of each stem 216.

In order to afford the desired molecular orientation, the walls of the cavities should be cooled to a temperature such that the injected resin solidifies along the walls while continuing to fill the core of each cavity. After the core of a cavity has been filled, the cooling must be continued to maintain the molecular orientation and to allow the stem to be pulled from the cavity. Afterwards, it may be desirable to apply heat to the wall of the cavity before it is again injected with resin.

Because the stems 216 of the novel hook strip 200 are molecularly orientated as evidenced by a birefringence value of at least 0.001, they have significantly greater stiffness and durability, as well as greater tensile and flexural strength, than would be achievable without such orientation. Because of these qualities, the portions of the stems 216 not heated by the heated surface remain resiliently flexible during the deforming step f) which preferably involves the application of heat to the stem tips by contact with the heated surface of a metal roller. Such contact forms the tip of each stem into a circular disc shaped mushroom head 218 at the tip of each stem 216, which head 218 has a substantially flat inner surface 217 that enhances its holding power when engaged with a loop.

As is illustrated in FIG. 11, the disc-like head shape with its high diameter to thickness ratio, and the small size and close spacing or high density of individual hooks that are provided by the novel hook strip 200 makes it able to easily firmly releasably engage loop material in shear, possibly because the many thin heads can easily move radially into engagement with rather small loops. Thus the hook strip 200 is particularly useful for hook-and-loop fastening when the loops are provided by the fibers of conventional knit or woven fabrics such as the illustrated woven fabric 222. In general, the hooks are of uniform height, preferably of from about 0.10 to 1.27 mm in height, and more preferably from about 0.18 to 0.51 mm in height; have a density on the backing preferably of from 60 to 1,550 hooks per square centimeter, and more preferably from about 125 to 690 hooks per square centimeter; have a stem diameter adjacent the heads of the hooks preferably of from 0.076 to 0.635 mm, and more preferably from about 0.127 to 0.305 mm; have circular disc-like heads that project radially past the stems on each side preferably by an average of about 0.013 to 0.254 mm, and more preferably by an average of about 0.025 to 0.127 mm and have average thicknesses between their outer and inner surfaces (i.e., measured in a direction parallel to the axis of the stems) preferably of from about 0.013 to 0.254 mm and more preferably of from about 0.025 mm to 0.127 mm, with the heads having average head diameter (i.e., measured radially of the axis of the heads and stems) to average head thickness ratio preferably of from 1.5:1 to 12:1, and more preferably from 2.5:1 to 6:1.

To have both good flexibility and strength, the backing of the novel mushroom-type hook strip preferably is from 0.025 to 0.512 mm thick, and more preferably is from 0.064 to 0.254 mm in thick, especially when the hook strip is made of polypropylene or a copolymer of polypropylene and polyethylene.

Virtually any orientable thermoplastic resin that is suitable for extrusion molding may be used to produce the novel mushroom-type hook strip. Thermoplastic resins that can be extrusion molded and should be useful include polyesters such as poly(ethylene terephthalate), polyamides such as nylon, poly(styrene-acrylonitrile), poly(acrylonitrile-butadiene-styrene), polyolefins such as polyethylene, polypropylene, and plasticized polyvinyl chloride. A preferred thermoplastic resin is a random copolymer of polypropylene and polyethylene containing 17.5% polyethylene and having a melt flow index of 30, that is available as SRD7-463 from Shell Oil Company, Houston, Tex.

Figure 12:
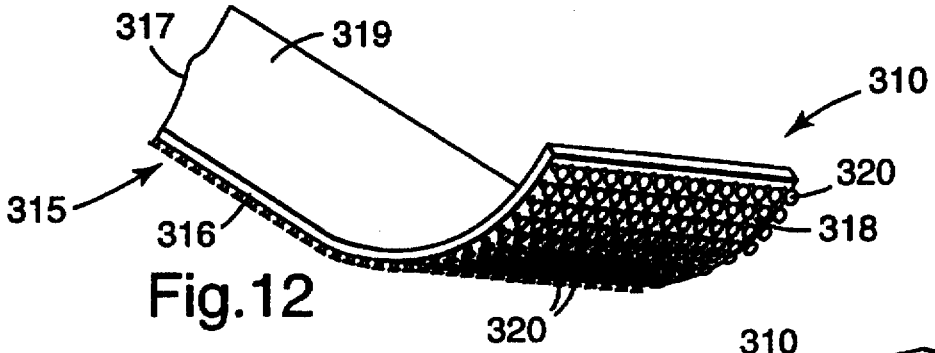
FIG. 12 is a perspective view of a fifth embodiment of a mounting composite according to the present invention.
Figure 13:
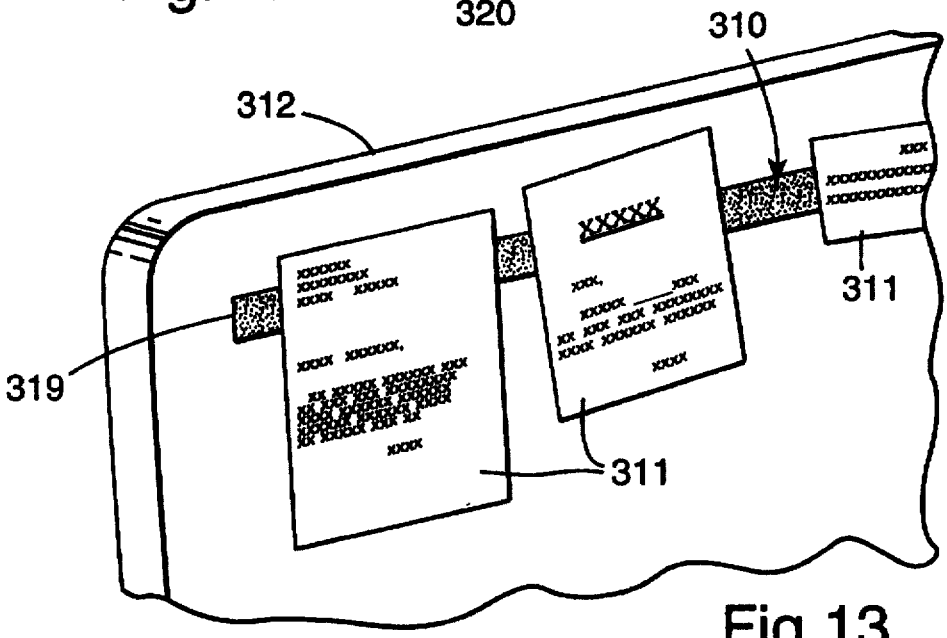
FIG. 13 is a perspective view of the embodiment of the mounting composite illustrated in FIG. 12 being used on a fabric covered wall.

Referring now to FIGS. 12 and 13 of the drawing, them is shown a mounting composite according to the present invention generally designated by the reference numeral 310 that is adapted for removably mounting sheet materials 311 on a vertical wall 312 of the type covered with woven or knitted fabric having thread densities in the range of about 8 to 32 threads per inch and commonly used to form office cubicles.

Generally, as is seen in FIG. 12, the mounting composite 310 comprises a fastener strip 315 including a base layer 316 which provides a support layer for the composite 310 and has opposite front and rear major surfaces 317 and 318, means in the form of a layer 319 of repositionable or removable pressure sensitive adhesive along and attached to the front surface 317 of the base layer 316 for retaining and displaying sheet materials along that front surface 317, and a multiplicity of hook-like projections 320 projecting from the rear surface 317 of the base layer 316. The hook-like projections 320 are integral with the base layer 316, and can be any of the types of hook-like projections described above, including the type described in U.S. Pat. No. 5,077,870, the type described in U.S. patent application Ser. No. 08/048874 filed Apr. 16, 1993, or the type described in U.S. Pat. No. 5,058,247.

The mounting composite 310 can be supplied in a roll, and cut to a desired length. The severed length of mounting composite 310 can then be attached to the fabric on the wall 312 by its hook-like projections 320, and sheet material 311 such as pieces of paper can then be releasably adhered to the layer 319 of adhesive exposed along the mounting composite 310 as is illustrated in FIG. 13.

Figure 14:
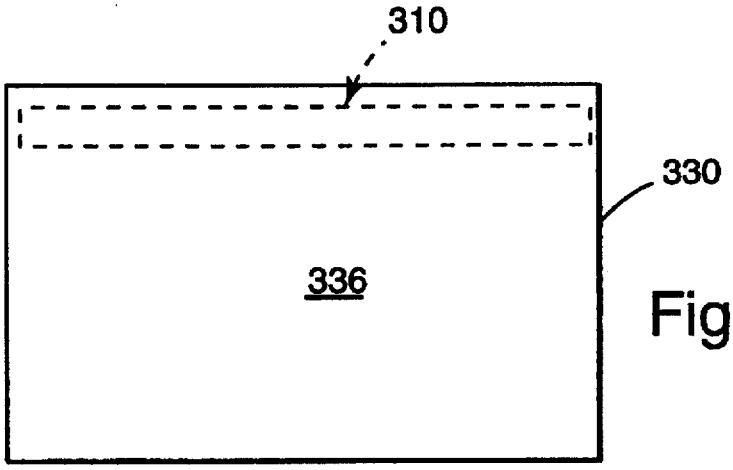
FIG. 14 is a front view of a sixth embodiment of a mounting composite according to the present invention.

As is illustrated in FIG. 14, the mounting composite 310 can alternatively be used in combination with a backing layer 330 of a stiff or flexible material (e.g., of cardboard, paper, polymeric film, etc.) having a front surface covered with a layer 336 of repositionable or removable pressure sensitive adhesive on which sheet materials may be releasably adhered. One or more lengths (as needed) of the mounting composite 310 are adhered to the rear surface of the backing layer 330 by their layers of pressure sensitive adhesive, and the hook-like projections 320 on the lengths of mounting composite 310 can then be engaged with a woven or knitted fabric on a vertical wall to support the backing layer 330 on that wall.

Figure 15:
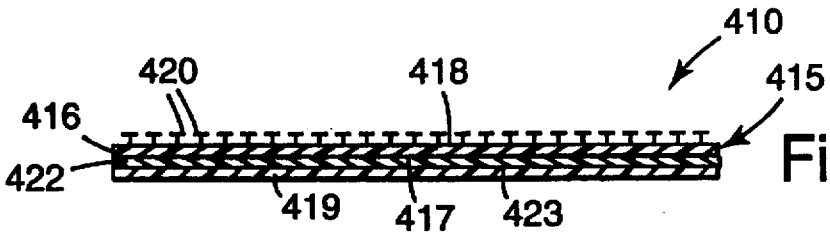
FIG. 15 is an enlarged edge view of a seventh embodiment of a mounting composite according to the present invention.

FIG. 15 illustrates a modification of the mounting composite 310 generally designated by the reference numeral 410 that is also adapted for removably mounting sheet materials 311 on a vertical wall 312 of the type covered with woven or knitted fabric. Generally, the mounting composite 410 comprises a fastener strip 415 including a base layer 416 which has opposite front and rear major surfaces 417 and 418, a backing layer 422 fastened as by a suitable adhesive or by heat sealing to the front surface 417 of the base layer 416 which together with the base layer 416 provides a support layer for the composite 410, and means in the form of a layer 419 of repositionable or removable pressure sensitive adhesive along and attached to a front surface 423 of the backing layer 422 opposite the fastener strip 415 for retaining and displaying sheet materials along that front surface 423. A multiplicity of hook-like projections 420 project from the rear surface 418 of the base layer 416. The hook-like projections 420 are integral with the base layer 416, and can be any of the types of hook-like projections described above, including the type described in U.S. Pat. No. 5,077,871, issued Jan. 7, 1992; the type described in U.S. patent application No. 08/048874 filed Apr. 16, 1993; or the type described in U.S. Pat. No. 5,058,247.

The backing layer 422 can be of paper, film (e.g., "Surlyn" (trademark) film), foil or other suitable material. The backing layer 422 can be printed along the front surface with graphics including designs, messages, scenes, characters, etc. Those graphics are visible through the layer 419 of adhesive and can make the mounting composite 410 more acceptable in appearance when it is attached to the wall without documents attached to it.

The mounting composite 410 can be supplied in a roll, and cut to a desired length. The severed length of mounting composite 410 can then be attached to the fabric on the wall 312 by its hook-like projections 420, and, as with the mounting composite 310 illustrated in FIG. 13, sheet material such as pieces of paper can then be releasably adhered to the layer 419 of adhesive exposed along the mounting composite 410. Alternatively, the mounting composite 410 (and also the mounting composite 310) can be cut into small segments which could have various peripheral shapes, including, but not limited to, rectangular, circular, octagonal, or the outline of objects, birds, or animals. Such segments could be used in a manner similar to that described above.

The layers 319 or 419 of adhesive on either of the mounting composites 310 or 410 can be protected with a clear film liner (not illustrated) prior to use, and that liner can be positioned over exposed portions of that layer 319 or 419 of adhesive when the mounting composite 310 or 410 is attached to the wall 312.

The present invention has now been described with reference to several embodiments and modifications thereof. It will be apparent to those skilled in the art that many changes can be made in the embodiments described without departing from the scope of the present invention. For example, using the method for forming the hook like portions described in U.S. Pat. No. 5,058,247, it would be possible to form the hook-like portions directly on the rear major surface of the backing layer. Thus the scope of the present invention should not be limited to the structures described in this application, but only by structures described by the language of the claims and the equivalents of those structures.

We claim:

1. A mounting composite for removably mounting sheet materials on a vertical wall covered with woven or knitted fabric, said mounting composite comprising;

a backing layer having opposite front and rear major surfaces;

means along said front surface and attached to said backing layer for retaining and displaying sheet materials along said front surface; and a first fastener strip including a base layer having opposite front and rear major surfaces, said rear major surface being attached surface to surface along the rear major surface of said backing layer, and said fastener strip further including a multiplicity of curved projections, each projection being integral with said base layer, decreasing in cross sectional area away from said base layer, having a pointed end portion opposite said base layer, and being curved away from said base layer in the same hook direction generally parallel to the front surface of said base layer with the pointed end portions being generally pointed in said hook direction;

said mounting composite being adapted to be removably attached on a vertical wall formed of woven or knitted fabric with the pointed end portions of said projections directed generally vertically downwardly.

2. A mounting composite according to claim 1 wherein said backing layer has a rectangular periphery defined by opposite first and second parallel end edges and first and second parallel side edges; the base layer of said first fastener strip is elongate and is fastened along said first end edge with said hook direction being at right angles to said first end edge and directed toward said second end edge, said means along said front surface and attached to said backing layer for retaining and displaying sheet materials along said front surface is a transparent polymeric front layer having a periphery of the same size and shape as at least a portion of said backing layer and having said periphery attached to the periphery of said backing layer along said side edges and along said second end edge, while the periphery of said front layer adjacent the first end edge of said backing layer is unattached to said backing layer to afford positioning sheet materials between said front surface and said front layer.

3. A mounting composite according to claim 1 wherein said backing layer has a rectangular periphery defined by opposite first and second parallel end edges and first and second parallel side edges; the base layer of said first fastener strip is elongate and is fastened along said first side edge with said hook direction being at right angles to said first side edge and directed toward said second side edge, said means along said front surface and attached to said backing layer for retaining and displaying sheet materials along said front surface is a transparent polymeric front layer having a periphery of about the same size and shape as at least a portion of said backing layer and having said periphery attached to the periphery of said backing layer along said side edges and along said first end edge, while the periphery of said front layer adjacent the second end edge of said backing layer is unattached to said backing layer to afford positioning sheet materials between said front surface and said front layer.

4. A mounting composite according to claim 3 further including a second fastener strip having the same structure as said first fastener strip, said second fastener strip being fastened along said second side edge with said hook direction for said second fastener strip being at right angles to said second side edge and directed toward said first side edge.

5. A mounting composite according to claim 1 wherein said means along said front surface and attached to said backing layer for retaining and displaying sheet materials along said front surface comprises a layer of repositionable or removable pressure sensitive adhesive along said front surface.

6. A mounting composite according to claim 5 wherein said means along said front surface and attached to said backing layer for retaining and displaying sheet materials along said front surface further comprises a transparent polymeric front layer having a periphery of the same size and shape as at least a portion of said backing layer and having said periphery attached to the periphery of said backing layer along one of said edges, said front layer being separable from said layer of pressure sensitive adhesive and pivotable away from said front surface at said one edge to afford adhering sheet materials to said layer of pressure sensitive adhesive, and subsequently being adhereable to portions of said layer of pressure sensitive adhesive around those sheet materials while extending over those sheet materials.

7. A mounting composite according to claim 5 wherein said means along said front surface and attached to said backing layer for retaining and displaying sheet materials along said front surface further comprises a frame assembly including a transparent polymeric front layer having peripheral edges and a frame attached to said front layer, said frame having an inner edge extending around a portion of said front layer, said portion of said front layer extending along at least a portion of the front surface of said backing layer and said front layer having one of said edges attached to the periphery of said backing layer along one of the edges of said backing layer, said front layer being separable from said layer of pressure sensitive adhesive and said frame assembly being pivotable away from said front surface at said one of said edges to afford adhering sheet materials to said layer of pressure sensitive adhesive, and subsequently being adhereable to portions of said layer of pressure sensitive adhesive around those sheet materials while extending over those sheet materials.

8. A mounting composite according to claim 7 wherein said frame has extending portions projecting past said edges of said backing layer and said mounting composite further includes an auxiliary fastener strip having essentially the same structure as said first fastener strip, said auxiliary fastener strip is fastened along said extending portion adjacent to said first fastener strip with said hook direction for said auxiliary fastener strip being the same as the hook direction for said auxiliary fastener strip.

9. A mounting composite for removably mounting sheet materials on a vertical wall covered with woven or knitted fabric, said mounting composite comprising;

a backing layer having opposite front and rear major surfaces;

means along said front surface and attached to said backing layer for retaining and displaying sheet materials along said front surface; and a first fastener strip including a base layer having opposite front and rear major surfaces, said rear major surface being attached surface to surface along the rear major surface of said backing layer, said first fastener strip further including, integral with said base layer, an array of upstanding stems distributed across the front surface of the base layer and a mushroom head at the end of each stem opposite the base layer, said mushroom heads having circular disc shapes with generally planar end surfaces opposite the base layer, which disc shaped heads have diameter to thickness ratios of greater than about 1.5 to 1;

said mounting composite being adapted to be removably attached on a vertical wall covered with woven or knitted fabric by said first fastener strip.

10. A mounting composite according to claim 9 wherein said backing layer has a rectangular periphery defined by opposite first and second parallel end edges and first and second parallel side edges; the base layer of said first fastener strip is elongate and is fastened along said first end edge, said means along said front surface and attached to said backing layer for retaining and displaying sheet materials along said front surface is a transparent polymeric front layer having a periphery of the same size and shape as at least a portion of said backing layer and having said periphery attached to the periphery of said backing layer along said side edges and along said second end edge, while the periphery of said front layer adjacent the first end edge of said backing layer is unattached to said backing layer to afford positioning sheet materials between said front surface and said front layer.

11. A mounting composite according to claim 9 wherein said backing layer has a rectangular periphery defined by opposite first and second parallel end edges and first and second parallel side edges; the base layer of said first fastener strip is elongate and is fastened along said first side edge, said means along said from surface and attached to said backing layer for retaining and displaying sheet materials along said front surface is a transparent polymeric front layer having a periphery of the about the same size and shape as at least a portion of said backing layer and having said periphery attached to the periphery of said backing layer along said side edges and along said second end edge, while the periphery of said from layer adjacent the first end edge of said backing layer is unattached to said backing layer to afford positioning sheet materials between said front surface and said front layer.

12. A mounting composite according to claim 11 further including a second fastener strip having the same structure as said first fastener strip, said second fastener strip being fastened along said second side edge.

13. A mounting composite according to claim 9 wherein said means along said front surface and attached to said backing layer for retaining and displaying sheet materials along said front surface comprises a layer of repositionable or removable pressure sensitive adhesive along said front surface.

14. A mounting composite according to claim 13 wherein said means along said front surface and attached to said backing layer for retaining and displaying sheet materials along said front surface further comprises a transparent polymeric front layer having a periphery of the same size and shape as at least a portion of said backing layer and having said periphery attached to the periphery of said backing layer along one of said edges, said front layer being separable from said layer of pressure sensitive adhesive and pivotable away from said front surface at said one edge to afford adhering sheet materials to said layer of pressure sensitive adhesive, and subsequently being adhereable to portions of said layer of pressure sensitive adhesive around those sheet materials while extending over those sheet materials.

15. A mounting composite according to claim 13 wherein said means along said front surface and attached to said backing layer for retaining and displaying sheet materials along said front surface further comprises a frame assembly including a transparent polymeric front layer having peripheral edges and a frame attached to said front layer, said frame having an inner edge extending around a portion of said front layer, said portion of said front layer extending along at least a portion of the front surface of said backing layer and said front layer having one of said edges attached to the periphery of said backing layer along one of the edges of said backing layer, said front layer being separable from said layer of pressure sensitive adhesive and said frame assembly being pivotable away from said front surface at said one of said edges to afford adhering sheet materials to said layer of pressure sensitive adhesive, and subsequently being adhereable to portions of said layer of pressure sensitive adhesive around those sheet materials while extending over those sheet materials.

16. A mounting composite according to claim 15 wherein said frame has extending portion projecting past said edges of said backing layer and said mounting composite further includes an auxiliary fastener strip having essentially the same structure as said first fastener strip, said auxiliary fastener strip being fastened along said extending portion adjacent to said first fastener strip.

17. A mounting composite for removably mounting sheet materials on a vertical wall covered with woven or knitted fabric, said mounting composite comprising;

a backing layer having opposite front and rear major surfaces;

means along said front surface and attached to said backing layer for retaining and displaying sheet materials along said front surface; and fastener means for releasably fastening to woven or knitted fabric along the rear major surface of said backing layer, said fastener means including a multiplicity of curved projections, each projection decreasing in cross sectional area away from said rear surface, having a pointed end portion opposite said rear surface, and being curved away from said rear surface in the same hook direction generally parallel to said rear surface with the pointed end portions being generally pointed in said hook direction;

said mounting composite being adapted to be removably attached on a vertical wall formed of woven or knitted fabric by said fastening means with the pointed end portions of said projections directed generally vertically downwardly.

18. A mounting composite according to claim 17 wherein said backing layer has a rectangular periphery defined by opposite first and second parallel end edges and first and second parallel side edges; said fastener means is elongate and is fastened along said first end edge with said hook direction being at right angles to said first end edge and directed toward said second end edge, said means along said front surface and attached to said backing layer for retaining and displaying sheet materials along said front surface is a transparent polymeric front layer having a periphery of the same size and shape as at least a portion of said backing layer and having said periphery attached to the periphery of said backing layer along said side edges and along said second end edge, while the periphery of said front layer adjacent the first end edge of said backing layer is unattached to said backing layer to afford positioning sheet materials between said front surface and said front layer.

19. A mounting composite according to claim 17 wherein said backing layer has a rectangular periphery defined by opposite first and second parallel end edges and first and second parallel side edges; said first fastener means is elongate and is fastened along said first side edge with said hook direction being at right angles to said first side edge and directed toward said second side edge, said means along said front surface and attached to said backing layer for retaining and displaying sheet materials along said front surface is a transparent polymeric front layer having a periphery of the about the same size and shape as at least a portion of said backing layer and having said periphery attached to the periphery of said backing layer along said side edges and along said first end edge, while the periphery of said front layer adjacent the second end edge of said backing layer is unattached to said backing layer to afford positioning sheet materials between said front surface and said front layer.

20. A mounting composite according to claim 19 further including a second fastener means having the same structure as said first fastener means, said second fastener means is fastened along said second side edge with said hook direction for said second fastener means being at right angles to said second side edge and directed toward said first side edge.

21. A mounting composite according to claim 17 wherein said means along said front surface and attached to said backing layer for retaining and displaying sheet materials along said front surface comprises a layer of repositionable or removable pressure sensitive adhesive along said front surface.

22. A mounting composite according to claim 21 wherein said means along said front surface and attached to said backing layer for retaining and displaying sheet materials along said front surface further comprises a transparent polymeric front layer having a periphery of the same size and shape as at least a portion of said backing layer and having said periphery attached to the periphery of said backing layer along one of said edges, said front layer being separable from said layer of pressure sensitive adhesive and pivotable away from said front surface at said one edge to afford adhering sheet materials to said layer of pressure sensitive adhesive, and subsequently being adhereable to portions of said layer of pressure sensitive adhesive around those sheet materials while extending over those sheet materials.

23. A mounting composite according to claim 21 wherein said means along said front surface and attached to said backing layer for retaining and displaying sheet materials along said front surface further comprises a frame assembly including a transparent polymeric front layer having peripheral edges and a frame attached to said front layer, said frame having an inner edge extending around a portion of said front layer, said portion of said front layer extending along at least a portion of the front surface of said backing layer and said front layer having one of said edges attached to the periphery of said backing layer along one of the edges of said backing layer, said front layer being separable from said layer of pressure sensitive adhesive and said frame assembly being pivotable away from said front surface at said one of said edges to afford adhering sheet materials to said layer of pressure sensitive adhesive, and subsequently being adhereable to portions of said layer of pressure sensitive adhesive around those sheet materials while extending over those sheet materials.

24. A mounting composite according to claim 23 wherein said frame has extending portions projecting past said edges of said backing layer and said mounting composite further includes an auxiliary fastener means having essentially the same structure as said first fastener means, said auxiliary fastener means is fastened along said extending portions adjacent to said first fastener means with said hook direction for said auxiliary fastener means being the same as the hook direction for said auxiliary fastener means.

25. A mounting composite for removably mounting sheet materials on a vertical wall covered with woven or knitted fabric, said mounting composite comprising;

a support layer having opposite front and rear major surfaces;

means along said front surface and attached to said support layer for retaining and displaying sheet materials along said front surface; and fastener means for releasably fastening to woven or knitted fabric along the rear major surface of said support layer, said fastener means including an array of upstanding stems distributed across the front surface of the support layer and a mushroom head at the end of each stem opposite the base layer, said mounting composite being adapted to be removably attached on a vertical wall covered with woven or knitted fabric by engagement of said mushroom heads with the fibers of said fabric.

26. A mounting composite according to claim 25 wherein said support layer is elongate and integral with said stems and mushroom heads, and said means along said front surface and attached to said support layer for retaining and displaying sheet materials along said front surface comprises a layer of repositionable or removable pressure sensitive adhesive.

27. A mounting composite according to claim 25 wherein said support layer is elongate and comprises a base layer integral with said stems at the end of said stems opposite said heads, and a backing layer attached to the side of said base layer opposite said stems and defining said front surface and said means along said front surface and attached to said backing layer for retaining and displaying sheet materials along said front surface comprises a layer of repositionable or removable pressure sensitive adhesive.

28. A mounting composite according to claim 27 wherein said base layer has graphics along said front surface visible through said layer of adhesive.

29. A mounting composite according to claim 25 wherein said support layer comprises a backing layer having a rectangular periphery defined by opposite first and second parallel end edges and first and second parallel side edges; said fastener means is elongate and is fastened along one of said edges, and said means along said front surface and attached to said backing layer for retaining and displaying sheet materials along said front surface comprises a layer of repositionable or removable pressure sensitive adhesive.

30. In combination, a vertical wall covered with woven or knitted fabric, and a mounting composite for removably mounting sheet materials on said vertical wall, said mounting composite comprising;

a support layer having opposite front and rear major surfaces;

means along said front surface and attached to said support layer for retaining and displaying sheet materials along said front surface; and fastener means along the rear major surface of said support layer, said fastener means including an array of upstanding stems distributed across the front surface of the support layer and a mushroom head at the end of each stem opposite the base layer, said mounting composite being removably attached on said vertical wall by engagement of said mushroom heads with the fibers of said fabric.

31. A combination according to claim 30 wherein said support layer is elongate and integral with said stems and mushroom heads, and said means along said front surface and attached to said support layer for retaining and displaying sheet materials along said front surface comprises a layer of repositionable or removable pressure sensitive adhesive.

32. A combination according to claim 30 wherein said support layer is elongate and comprises a base layer integral with said stems at the end of said stems opposite said heads, and a backing layer attached to the side of said base layer opposite said stems and defining said front surface, and said means along said front surface and attached to said backing layer for retaining and displaying sheet materials along said front surface comprises a layer of repositionable or removable pressure sensitive adhesive.

* * * * *